US005906139A

United States Patent [19]

Beugelsdyk et al.

[11] Patent Number: 5,906,139

[45] Date of Patent: May 25, 1999

[54] CONTROL ASSEMBLY WITH LOCKING COLLET

[75] Inventors: Anthony F. Beugelsdyk; Michael A. Barnard, both of Wichita, Kans.

[73] Assignee: Wescon Products Company, Wichita, Kans.

[21] Appl. No.: 08/967,964

[22] Filed: Nov. 12, 1997

[51] Int. Cl.[6] ..... G05G 5/22

[52] U.S. Cl. ..... 74/502; 74/531; 403/350

[58] Field of Search ..... 74/502, 531, 502.4; 403/350, 358, 356, 355

[56] References Cited

U.S. PATENT DOCUMENTS

| | | | |
|---|---|---|---|
| 1,821,576 | 9/1931 | Potter et al. | 74/502 |
| 2,502,780 | 4/1950 | Dreffein | 74/502 |
| 3,416,390 | 12/1968 | Houk | 74/502 X |

FOREIGN PATENT DOCUMENTS

| | | | |
|---|---|---|---|
| 2408173 | 6/1979 | France | 74/502.4 |

OTHER PUBLICATIONS

Western Control Company catalog—1972–73 (7pgs.).
Wescon Products catalog—1974 (7pgs.).
Western Control Corporation—Remote Mechanical Controls binder (11pgs.)–date unknown.
Wescon Products Company binder—1978 (8pgs.).

*Primary Examiner*—Charles A. Marmor
*Assistant Examiner*—Mary Ann Battista
*Attorney, Agent, or Firm*—Hovey, Williams, Timmons & Collins

[57] ABSTRACT

A push-pull control assembly which is lockable with respect to translational movement includes a rod received with a tube with a control cable attached to the rod and a collet received on an off-centered portion of the rod. The collet includes a raised ridge received within a keyway on the interior channel of the tube whereby the collet does not rotate but is free to translate within the channel. By turning the rod either clockwise or counterclockwise, the collet is wedged against the channel by the off-centered portion of the rod to lock the rod and thus the control cable against further movement. A key may be provided in addition to the collet to modify and limit the available translational movement of the rod.

10 Claims, 3 Drawing Sheets

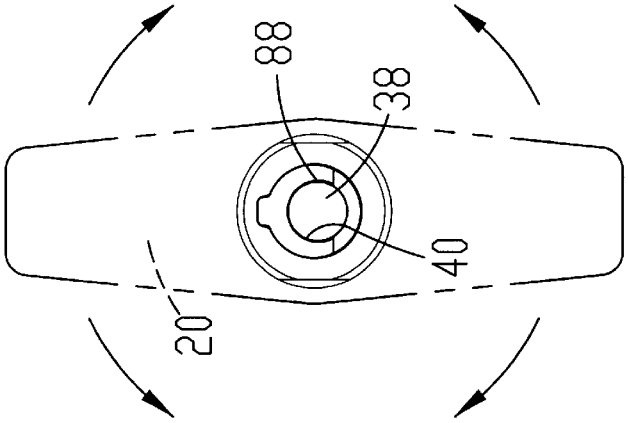
Fig. 5.
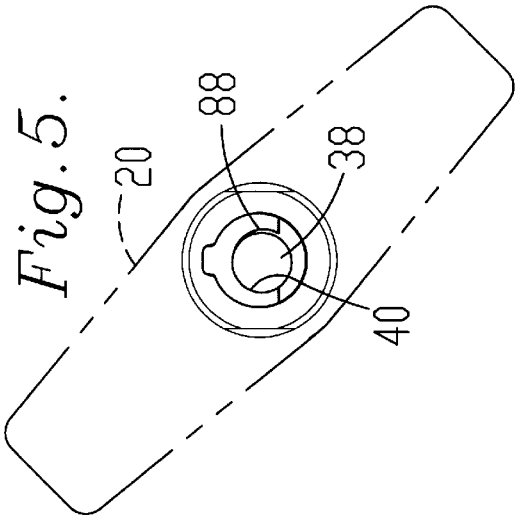
Fig. 6.
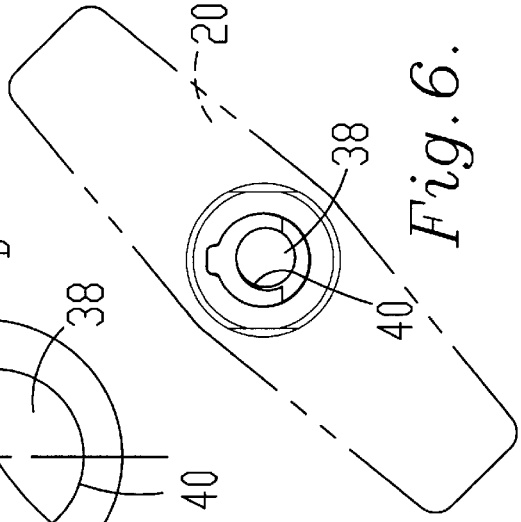
Fig. 7.
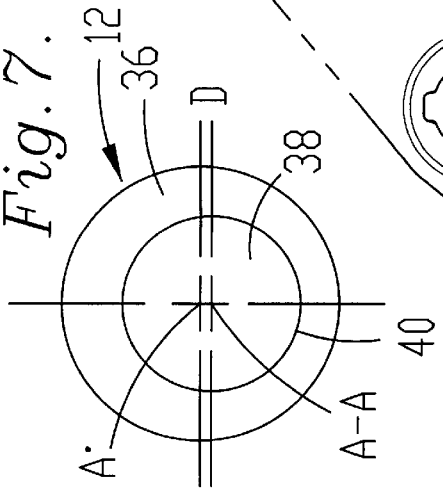
Fig. 4.
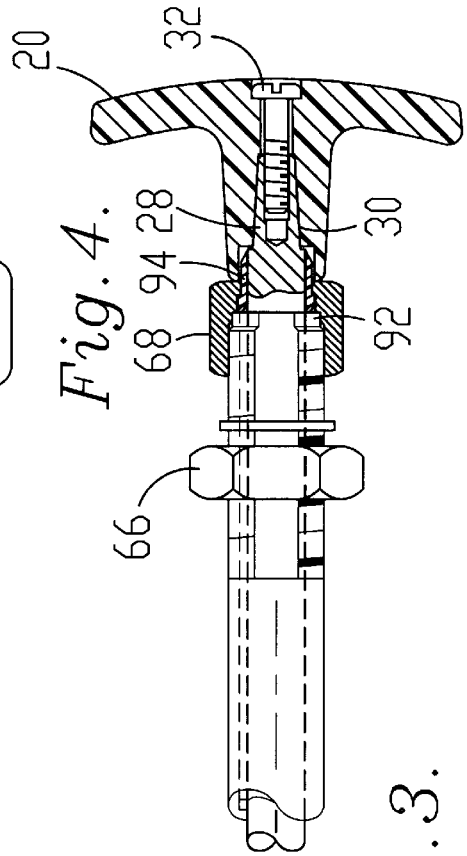
Fig. 3.
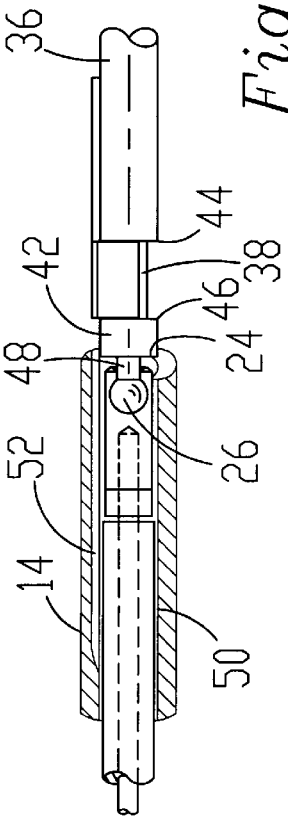

CONTROL ASSEMBLY WITH LOCKING COLLET

BACKGROUND OF THE INVENTION

1. Field of the Invention

This invention broadly concerns a control assembly which may be locked along its range of translation. More particularly, it concerns a control assembly using a locking collet whereby locking rotational movement of a rod received within a tubular body serves to lock the control against translation and thereby fix a relative position of a control cable operatively connected to a control actuator.

2. Description of the Prior Art

Various types of control assemblies for actuating remotely located operating mechanisms are well known in the art include various types of levers and the like to which control cables are attached. In some operating environments, it is desirable to use push-pull types of controls for ergometric reasons or to differentiate critical control mechanisms from one another.

In some circumstances, it is desirable to provide push-pull control assemblies which can be held at different positions along their length of travel. Once such example would be in the area of throttle controls wherein a particular engine speed may be selected by the operator. An alternative use for such controls would be to set the position for a snow blower discharge chute. In such instances, it is desirable for the operator to be able to choose among an infinite number of settings within the operating range, rather than being forced to engage the mechanism at one of several preselected positions.

It may be appreciated that once the operator has determined the desired position of the control, such as by obtaining desired engine speed, he may wish to lock that control in position to avoid undesired slippage causing a change in the operating characteristics of the equipment. It may also be appreciated that simplicity of operation and reliability for maintaining the setting so selected, are important characteristics for the design of such a control mechanism.

One design for a control assembly providing locking characteristics is currently known as a "flattened rod". This design consists of a round tube with an oval inner hole and a rod attached to a knob, the rod having a flattened portion, approximately 1" long at the center of the rod. When the rod is rotated, the flattened portion comes in contact with the oval interior surface of the tube, and thereby wedges itself against the reduced dimension along the minor axis of the oval inner surface. This prevents the rod from longitudinal translational movement. One problem with this type of device lies in the necessity of providing close tolerances for the oval interior surface of the tube and the flattened portion across the width of the rod flattened area. If the flattened area ends up slightly wide by a few thousandths of an inch, the control fails to lock. On the other hand, if the flattened area is a few thousandths too narrow, the rod will spin and will not lock against the oval interior surface of the tube. In addition, this design for a control is sensitive to vibration and unlocks very easily. Furthermore, the ratio of rotational torque to longitudinal pull force is approximately 1 to 2 (1 lb. of torque force to 2 lb. of sliding force). Thus, the operator must exert excessive torque to the knob in order to get a fairly high locking force for the rod even when the flattened rod design is constructed according to design specifications.

Another existing design involves the use of a metal collet for locking the control rod in place. This design consists of a tube with a threaded internal section which receives therein a rod over which a threaded metal collet and a slanted collet is positioned. The slanted collet stops against a step on the inside of the tube. The threaded collet is positioned on top of the slanted collet and when the rod is rotated, the threaded collet rotates against the slanted collet, wedging the rod against the slanted collet. This in turn prevents the rod from longitudinal movement. One disadvantage of this metal collet-type of control is that it locks only in the clockwise direction and must be loosened by turning the knob in the counterclockwise direction. Another disadvantage of this type of control is the low torque to longitudinal force ratio, such that once the slanted collet begins to wear, the control begins to slip. Thus, it is not durable and has a relatively short operational life.

Accordingly, there has developed a need for a push-pull type of control assembly of a simplified design not subject to strict tolerances, which provides an acceptable torque to longitudinal force ratio, is durable and provides not only a widely selectable range of positions, but is also reliably lockable along its range of travel.

SUMMARY OF THE INVENTION

The control assembly of the present invention achieves these and other goals by the use of a unique locking collet assembly. As a result, the control assembly of the present invention is not only easy to use and provides the operator with the ability to select among an infinite number of settings within the range of the control, but also provides reliable locking engagement to maintain the desired setting, but is simple to construct, requires only a small amount of force to use, and is both durable and relatively inexpensive to construct. In particularly preferred embodiments, the control assembly may be provided with an insert to economically provide a means for reducing the length of travel of translation for the control rod.

These advantages are obtained by the push-pull control assembly which includes a tubular body, a rod shiftably received within the body which includes an eccentric thereon, a control cable connected to the rod, and a synthetic resin collet received within the tubular body. The collet is keyed within the tubular body whereby rotation of the rod causes the eccentric to engage the collet and wedge it against the interior surface of the tubular body. Thus, either clockwise or counterclockwise rocking of the rod will result in locking the collet and thus the rod against the interior surface of the tube, thereby preventing the rod from moving both rotationally and longitudinally within the tube.

In greater detail, the tube is preferably provided with a seal at the proximate end thereof and includes a longitudinally oriented keyway along a substantial portion of its length, the keyway being complementally sized with a ridge provided on the plastic collet. The inner surface of the tube is otherwise substantially cylindrical. The outer surface of the proximate end of the tube is preferably threaded for receiving thereon a threaded bezel nut and a jam nut for holding the control assembly on a control panel or the like. The rod receives thereon a knob at its proximate end and is provided with a fitting, such as a ball fitting at its remote end. The control cable is provided with a coupler for receiving the fitting thereon whereby translation of the rod within the tube causes concomitant shifting of the control cable, preferably within a protective sheath. The body may be crimped at its remote end or otherwise provided with a means of holding the proximate end of the sheath against movement of the cable with the sheath during shifting of the rod within the tube.

The collet is preferably fixed against longitudinal movement relative to the rod by shoulders on the rod thereby the collet is received on a portion of the rod of reduced internal diameter. The portion of reduced diameter receives the collet for rotatable movement therebetween, with the reduced diameter portion having a slightly smaller outside diameter than the arcuate inner dimension of the collet. Furthermore, the portion of the reduced diameter is slightly offset with respect to the axis of the remainder of the rod to thereby present an eccentric. In particularly preferred embodiments, a key is provided on the proximate side of the collet between the rod and the tube in the keyway of the latter when it is desired to limit the longitudinal translational movement of the rod.

As a result of the foregoing design, the rod may be rocked from a neutral, longitudinal shiftable position by twisting the knob in either a clockwise or counterclockwise direction to lock the rod relative to the tube. This permits the operator to lock the rod in position anywhere along its longitudinal length of travel by twisting the knob in either a clockwise or counterclockwise direction. The seal, rod, and collet serve as a guide for the rod within the tube sharing the smooth movement, and the provision of the collect of synthetic resin aids in lubricating the rod during shifting. The travel length for translation of the rod relative to the tube to thereby limit the concomitant travel of the cable may be easily modified by inserting keys of a desired limiting length. Thus, the length of travel permitted is the difference between the distance between the proximate end of the collet and a first step on the bezel mounted on the tube and the length of the key.

BRIEF DESCRIPTION OF THE DRAWINGS

FIG. 3 is an elevational view of the control assembly in partial section along line 3—3 of FIG. 1 with portions of the tube removed for clarity;

FIG. 4 is an enlarged vertical cross-sectional view through the tube adjacent the collet and the eccentric of the control rod along line 4—4 of FIG. 1 with the knob shown in phantom to illustrate the neutral position of the control permitting translational movement of the rod within the tube;

FIG. 5 is an enlarged vertical cross-sectional view similar to FIG. 4 showing the knob and rod rotated in a counterclockwise direction relative to FIG. 4 for locking the rod against translational movement relative to the tube;

FIG. 6 is an enlarged vertical cross-sectional view similar to FIG. 4 showing the knob and rod rotated in a clockwise direction relative to FIG. 4 for locking the rod against translational movement relative to the tube;

FIG. 7 is an enlarged vertical cross-sectional view through the reduced diameter portion of the control rod showing the offset axis of the reduced portion to define an eccentric;

DESCRIPTION OF THE PREFERRED EMBODIMENT

Figure 1:
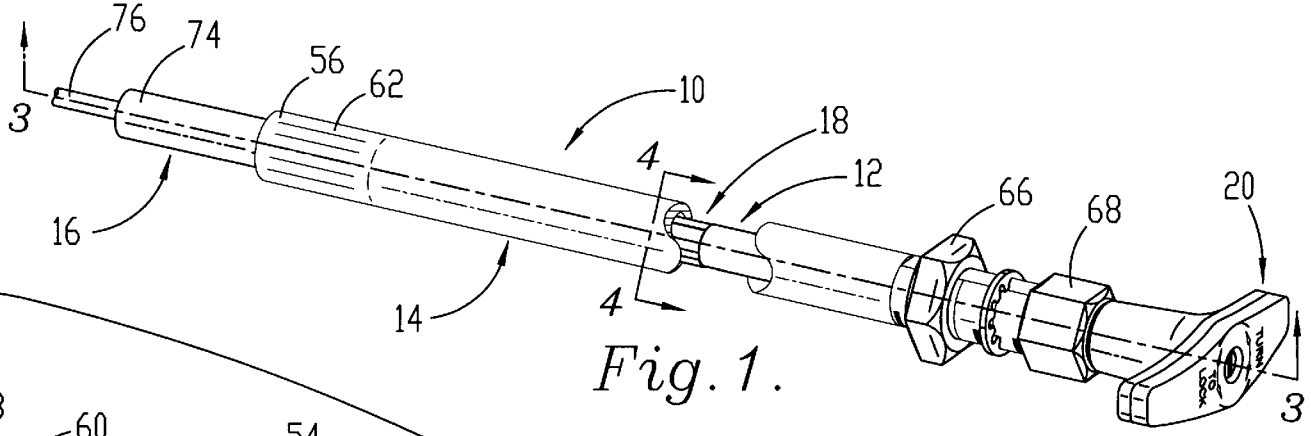
FIG. 1 is a perspective view from the proximate end of the control assembly thereof in partial section showing the assembled control assembly with a portion of the tube broken away to show the collet and control rod position therein.

Referring now to the drawing, FIG. 1 shows the control assembly 10 in accordance with the present invention which broadly includes a control rod 12 received within a tube 14, a Bowden cable 16 connected to the control rod 12 for translational movement therewith relative to the tube 14, and a collet 18 coupled to the control rod. Preferably, the control rod 12 is provided with a knob 20 or other suitable attachment for ease in grasping to permit both rotational or rocking movement of the rod as well as longitudinal translating movement of the rod. The control assembly 10 is normally mounted to a bracket, control panel, or other mounting structure whereby once installed, the tube may be relatively fixed in position such that all movement of the control rod is accomplished with respective to a relatively fixed position of the tube 14.

Figure 2:
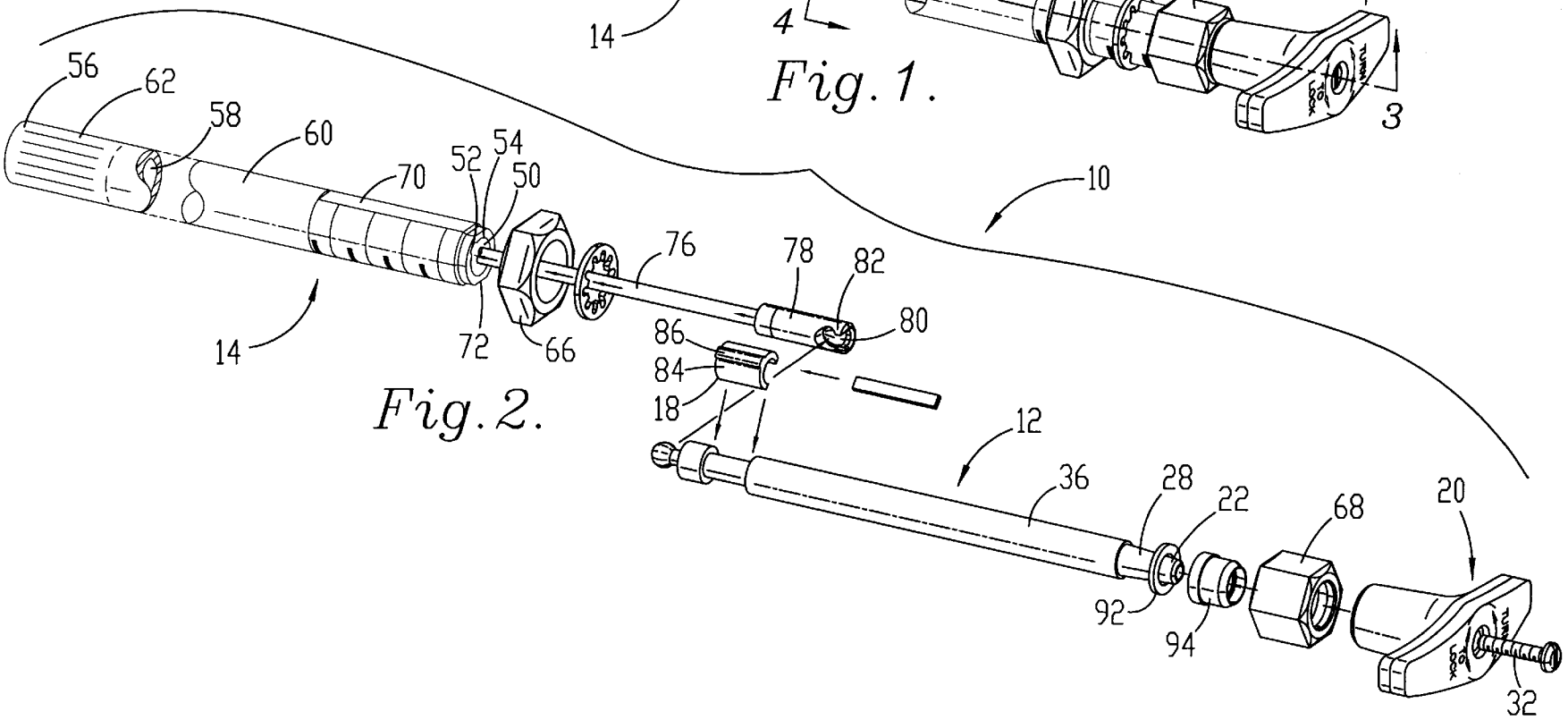
FIG. 2 is an exploded perspective view of the control assembly of FIG. 1 with the sheath of the control cable omitted for clarity.
Figure 8:
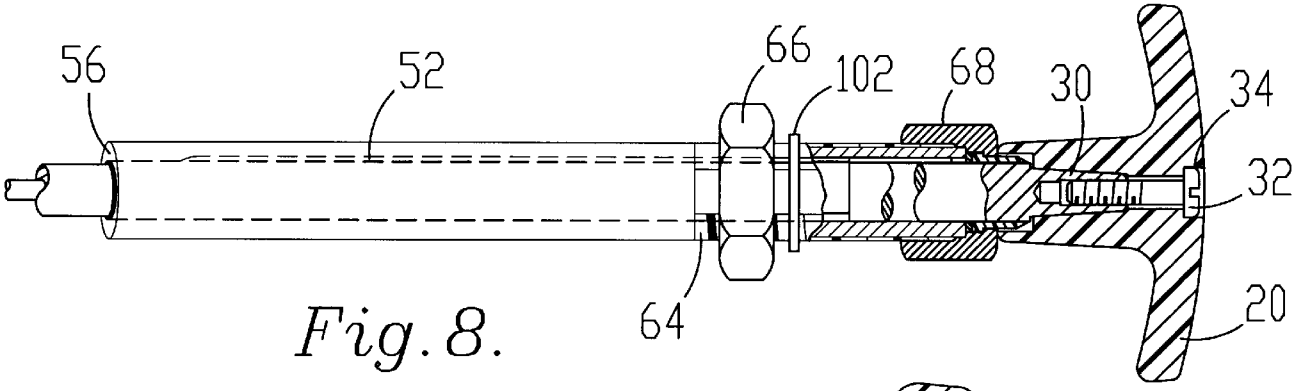
FIG. 8 is a vertical cross-sectional view of the control assembly showing the key position within the keyway and the rod for shortened for clarity.
Figure 9:
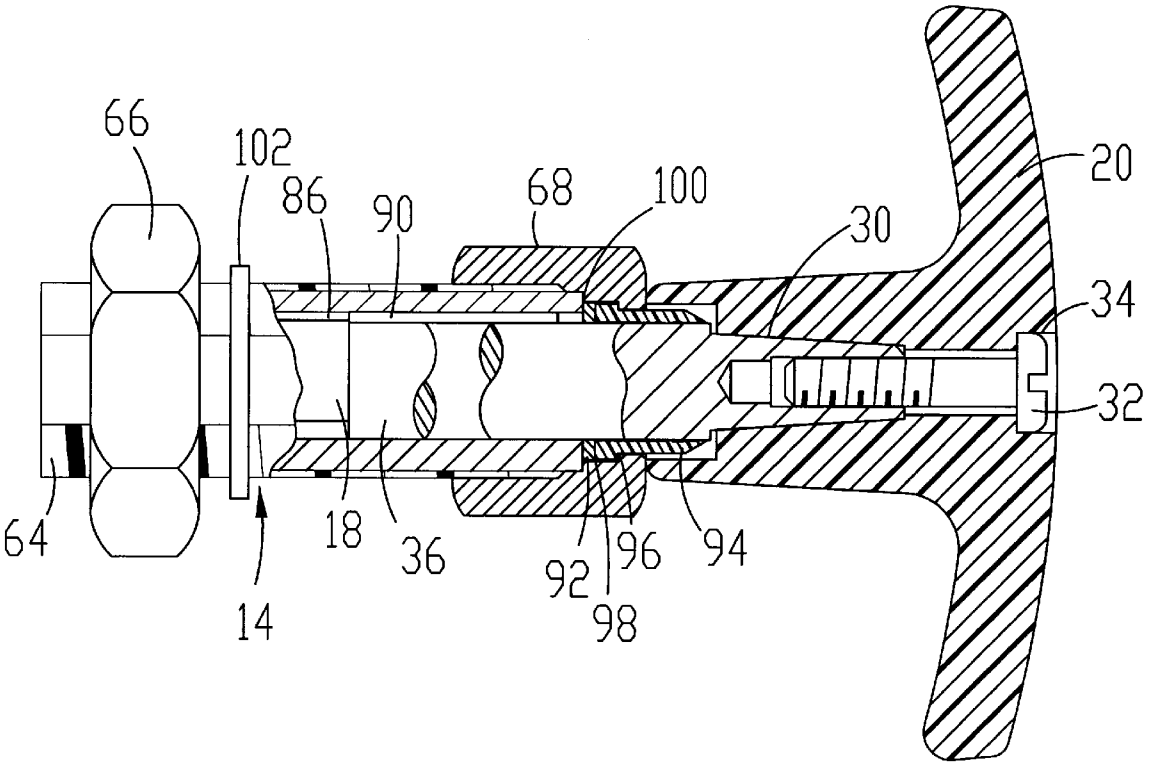
FIG. 9 is an enlarged vertical cross-sectional view similar to FIG. 8.

In greater detail, the control rod 12 is elongated between a proximate end 22 and a remote end 24 at which a ball fitting 26 is located as shown in FIG. 2. The proximate end 22 includes an insert 28 which is internally threaded and sized to be received within a receiving chamber 30 of the knob 20 as shown in FIGS. 3, 8 and 9. A set screw 32 is inserted through a centrally positioned opening 34 of the knob 20 and threaded onto the rod 12 for securing the rod 12 to the knob 20 against relative movement therebetween.

The control rod 12 is further provided with an elongated shaft 36 of a substantially circular outer dimension. A reduced diameter portion 38 is located remotely from the shaft 36. As shown in FIG. 7, the shaft 36 has a first central axis A while the reduced diameter portion 38 has second central axis AA which is offset by a dimension D relative to the first axis A to present an eccentric 40. A journal 42 is provided on rod 12 remotely from reduced diameter portion 38 as shown in FIG. 3. Shaft 36 and journal 42 present respective shoulders 44 and 46 with their reduced diameter portion 38 located therebetween. Rod 12 also includes tail extension 48 of further reduced diameter to space ball fitting 26 from journal 42.

Tube 14 is elongated and presents a central channel 50 along the length thereof. Channel 50 is substantially circular in cross-section with the exception of longitudinally extending keyway 52. Keyway 52, as may be seen in FIG. 2, extends to the proximate end 54 of the tube 14 but preferably does not extend to the a remote end 56 of the tube 14. The internal surface 58 of the tube 14 is thus substantially smooth except for keyway 52, and is unthreaded. The exterior surface 60 of the tube 14 is preferably provided with crimping 62 adjacent the remote end 56 to attach Bowden cable 16 and external threading 64 at the proximate end 54 of the tube 14 to threadably receive thereon jam nut 66 and bezel nut 68. As shown in FIG. 2, threading 64 may be interrupted by flattened surfaces 70 and 72 for facilitating assertion of the tube 14 through a complementally shaped opening of the control panel or other mounting structure.

Bowden cable 16 includes a sheath 74 which may be wire reinforced synthetic resin and an internal control cable 76 shiftable within the sheath 74. The control cable 76 is provided at its proximate end with a coupler 78 which includes a recess 80 for receiving ball fitting 26 therein and a neck 82 for preventing movement of the ball fitting 26 proximately once received in recess 80. The coupler 78 is sized for receipt within channel 50 of tube 14.

Collet 18 includes an arcuate outer surface 84 including ridge 86 complementally received within channel 50 and keyway 52 respectively of tube 14. Collet 18 includes an inner arcuate surface 88 having a radius slightly greater than that of the reduced diameter portion 38 to permit limited rotational movement of the reduced diameter portion 38 therewithin as shown by comparison of FIGS. 4, 5 and 6. A key 90 of a desired travel limiting length is positioned proximately of collet 18 on shaft 36 for receipt within keyway 52, but may be omitted entirely if the full length of travel of the rod 12 within tube 14 is desired. The collet 18 and the key 90 are preferably made of Minion, Delrin, Nylon or other friction-resistant synthetic resin material.

A sealing washer 92 of bronze or other metal and a seal 94 of neoprene or other resilient synthetic rubber material is positioning surrounding relationship to rod 12 between the knob 20 and the tube 14 whereby the rod 12 extends from the proximate end of the tube 14 for attachment to knob 20. Bezel nut 68 is threaded over sealing washer 92 and seal 94 onto external threading 64 of tube 14 as shown in FIGS. 3, 8 and 9. Bezel nut 68 includes a first collet portion 96 for retaining the seal 94 and sealing engagement around control rod 12 and a rim 98 for limiting the threading engagement of bezel nut 68 onto tube 14. Rim 98 and sealing washer 92 also serve as a stop 100 to prevent key 90 for collet 18 from being withdrawn from the interior channel 50 of the tube 14 and thus serve the additional function of limiting the translational pull travel of the control rod 12. A lock washer 102 may be additionally provided between bezel nut 68 and jam nut 66.

The control assembly 10 is assembled as described herein with the collet 18 snapped over the recessed reduced portion 38 of control rod 12 and the key 90 placed on shaft 36. The ridge 86 and key 90 are aligned with keyway 52 and the eccentric 40 in a neutral position as shown in FIG. 4 when the control rod 12 with the control cable 76 attached thereto is inserted into channel 50. As noted above, the key 90 may be divided of a desired length to limit the pull travel of the control rod 12 or omitted entirely to permit the control rod 12 to be pulled its entire length of travel.

When the control assembly 10 is installed on the device with the remote end of the control cable 76 connected to a carburetor, throttle control or other mechanism to be actuated, the control level may be actuated by pulling on the knob 20 to operate the actuated mechanism when the eccentric 40 is in the neutral position shown in FIG. 4. In that position, the control rod 12 may be pushed or pulled relative to the tube 14 to thereby shift the control cable 76. By rocking the knob 20 clockwise or counterclockwise, the eccentric 40 moves rotationally relative to the collet 18 to jam against the internal surface or channel 50 of the tube 14, as shown in FIGS. 5 and 6. This in turn locks the rod 12 and thus the control cable 76 against further translational movement relative to the tube 14. The rod 12 may unlocked simply by rocking or pivoting the knob 20 back to the neutral position shown in FIG. 4 whereby further translational shifting of the control rod 12 may be accomplished.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and assess the reasonably fair scope of their invention as pertains to any apparatus not materially departing from but outside the literal scope of the invention as set out in the following claims.

We claim:

1. A lockable push-pull control assembly for operating a remote controllable mechanism comprising:

an elongated tube presenting a proximate end and a remote end and having a channel and a longitudinally extending keyway;

a rod received in said channel for longitudinal translational movement and rotational rocking movement relative to said tube, said rod presenting a shaft portion having a first axis and a reduced diameter portion presenting a second axis offset with respect to said first axis;

a control cable coupled to said rod for translational movement therewith and extending from said remote end of said tube; and a collet presenting a ridge adapted for receipt in said keyway, said collet presenting an arcuate outer surface complemental to said channel for shiftable longitudinal movement therealong and an arcuate inner surface positioned on said reduced diameter portion.

2. A control assembly as set forth in claim 1, including a sheath surrounding said control cable secured to said remote end of said tube.

3. A control assembly as set forth in claim 1, including a knob secured to said rod opposite said control cable.

4. A control assembly as set forth in claim 1, wherein said rod includes a ball fitting relatively proximate the remote end of said tube, and said control cable includes a coupling connected to said ball fitting for permitting free rotational movement between said rod and said control cable.

5. A control assembly as set forth in claim 1, including a key positioned on said shaft portion of said rod and received in said keyway.

6. A control assembly as set forth in claim 5, wherein said key is located on the proximate side of said ridge of said collet.

7. A control assembly as set forth in claim 1, wherein said collet is provided of synthetic resin material.

8. A control assembly as set forth in claim 1, including a seal received around said rod and positioned at the proximate end of said tube.

9. A control assembly as set forth in claim 8, including a bezel nut threadably mounted on the proximate end of said tube for attaching said seal to said tube.

10. A control assembly as set forth in claim 1, wherein said channel is substantially circular in cross-section excepting said keyway.

* * * * *